United States Patent [19]

Bellaire

[11] Patent Number: 5,077,796

[45] Date of Patent: Dec. 31, 1991

[54] CRYPTOGRAPH

[76] Inventor: David L. Bellaire, 1701 W. El Caminito, Phoenix, Ariz. 85021

[21] Appl. No.: 535,965

[22] Filed: Jun. 11, 1990

[51] Int. Cl.[5] ..... G09C 1/06; A63F 3/06

[52] U.S. Cl. ..... 380/56; 380/59; 273/148 R; 273/148 A

[58] Field of Search ..... 380/54, 56, 57, 58, 380/59; 273/148 R, 148 A; 283/17, 73

[56] References Cited

U.S. PATENT DOCUMENTS

| | | | |
|---|---|---|---|
| 2,439,413 | 4/1948 | Mitchell | 380/59 |
| 4,600,198 | 7/1986 | Fox | 273/148 R |
| 4,607,845 | 8/1986 | Gallo | 273/148 R |
| 4,721,309 | 1/1988 | Miesel | 273/148 R |
| 4,752,073 | 6/1988 | Thompson | 273/148 R |
| 4,772,025 | 9/1988 | James et al. | 273/148 R |
| 4,781,379 | 11/1988 | Parks | 273/148 R |
| 4,892,313 | 1/1990 | James et al. | 273/148 R |

FOREIGN PATENT DOCUMENTS

| | | | |
|---|---|---|---|
| 2383684 | 11/1978 | France | 273/148 A |
| 0163042 | 2/1934 | Switzerland | 273/148 A |

OTHER PUBLICATIONS

Ehrlich et al., *Oxford American Dictionary,* (Oxford Univ. Press, New York, 1980), "Adjacent" (p. 10) & "Window" (p. 797).

*Primary Examiner*—Bernarr E. Gregory

*Attorney, Agent, or Firm*—Cahill, Sutton & Thomas

[57] ABSTRACT

An apertured device translatably receives a lottery ticket in juxtaposed relationship with the aperture to display a set of numbers appearing upon the lottery ticket. A panel adjacent the aperture accommodates entry of a predetermined set of numbers to permit visual correlation between the displayed set of numbers and the predetermined set of numbers.

5 Claims, 2 Drawing Sheets

CRYPTOGRAPH

BACKGROUND OF THE INVENTION

1. Field of the Invention

The present invention relates to deciphering devices and, more particularly, to devices for correlating a set of random numbers with a predetermined set of numbers.

2. Description of the Prior Art

Various mechanical decoding and deciphering devices have been evident for centuries, beginning with the Rosetta Stone. Most of these devices are cryptographic in nature and require complex mechanisms for deciphering purposes. With the recent availability of small scale computational electronic devices, the deciphering functions are less expensively and more rapidly performed electronically. Because the costs attendant such devices are relatively substantial, their use is limited to relatively sophisticated deciphering operations. At the other end of the scale are relatively simple inexpensive decoding devices, such as decoding rings and the like often given for free as premiums to children.

Various tabulators have been developed which include a sleeve like element for slidably receiving a card and having one or more windows. The card includes various indicia which is exposed through one or more of the windows by sliding the card within the sleeve. Each window includes surrounding indicia referenced with the indicia on the card to obtain a calculated figure or provide other information. Devices of this type are often used for the purpose of calculating monthly payments for any given principal amount at a set interest rate for a period of years. Other tabulators include information of particular use to various journeymen in performing their jobs.

Lotteries have been in existence for centuries. Generally, a lottery involves a lottery ticket having randomly selected or specifically selected numbers imprinted thereon. At the time of the drawing for the lottery, a group of numbers is drawn. To determine a winner, the numbers on a lottery ticket must match the drawn numbers. Some lotteries permit a multitude of sets of numbers imprinted per lottery ticket; in other cases, a participant may purchase a number of lottery tickets having a single set of numbers printed on each. When many sets of numbers must be matched to the drawn set of numbers, substantial time is required to compare each of several sets of numbers on a lottery ticket or to compare the set of numbers on a plurality of lottery tickets. Mistakes are often made due to eye strain and misreading of numbers.

SUMMARY OF THE INVENTION

An apertured card includes a panel for entering a predetermined set of numbers adjacent an edge of the aperture. A guide accommodates translation of a document having one or more sets of numbers past the aperture to permit one for one correlation of the set of numbers appearing on the card with the set of numbers appearing on the panel adjacent the aperture. Display of the predetermined set of numbers may be made manually or electronically.

It is therefore a primary object of the present invention to provide a device for accommodating translation of a document containing a first set of indicia to display the first set of indicia through a window and adjacent a second set of indicia disposed on the device by the window.

Another object of the present invention is to provide apparatus for comparing side by side a set of indicia with a predetermined set of indicia.

Still another object of the present invention is to provide apparatus for deciphering lottery tickets.

Yet another object of the present invention is to provide a one piece element for unambiguously correlating numbers on a lottery ticket with a drawn set of numbers.

A further object of the present invention is to provide a lottery ticket deciphering device for guiding the numbers on a lottery ticket past a window to permit visual correlation of such numbers with a manually entered set of numbers disposed adjacent the window.

A still further object of the present invention is to provide a method for rapidly deciphering a plurality of sets of numbers with a predetermined set of numbers.

A yet further object of the present invention is to provide a method for entering and correlating a predetermined set of numbers with a multiplicity of randomly selected numbers.

These and other objects of the present invention will become apparent to those skilled in the art as the description thereof proceeds.

BRIEF DESCRIPTION OF THE DRAWINGS

The present invention will be described with greater clarity and specificity with reference to the following drawings, in which.

DESCRIPTION OF THE PREFERRED EMBODIMENT

A lottery ticket includes a set of numbers which may be randomly assigned or, in certain situations, which may be selected by the lottery ticket holder. To win a lottery, a predetermined quantity of the numbers on the lottery ticket must correlate with an equivalent quantity of the numbers drawn at the lottery. When one or two sets of lottery ticket numbers have to be correlated with the drawn set of numbers, very little difficulty is usually encountered. However, when a lottery ticket includes many sets of numbers imprinted thereon or if a substantial quantity of lottery tickets, each having one or more sets of numbers, must be compared with the drawn number, the act of comparing becomes time consuming and errors often arise.

Figure 1:
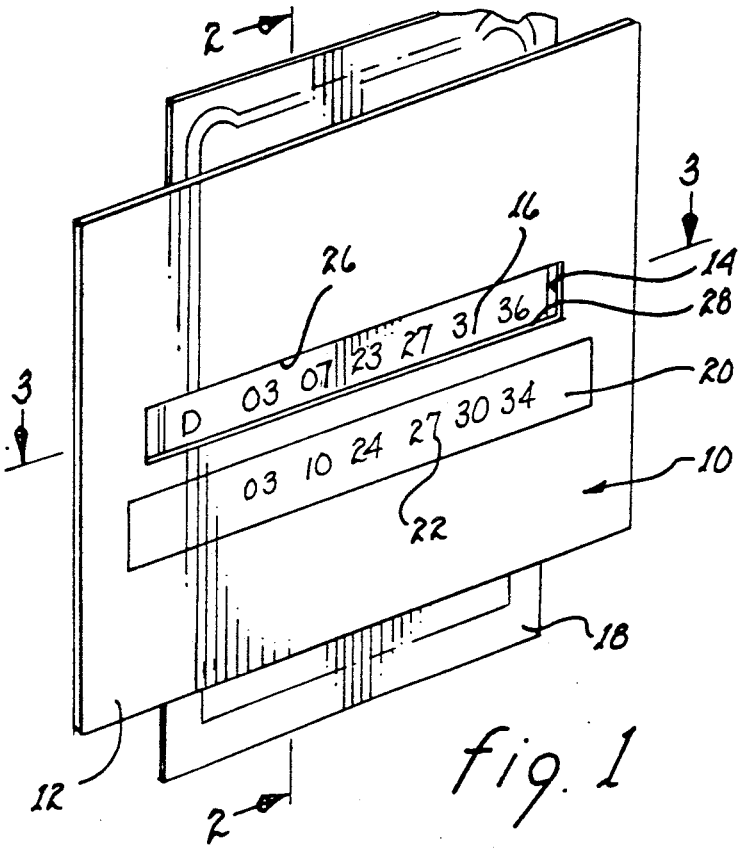
FIG. 1 is an isometric view of a deciphering device.

Referring to FIG. 1, there is shown a device 10 for mechanically locating the set of numbers imprinted upon a lottery ticket adjacent the set of numbers drawn at the lottery. Such adjacent placing of the two sets of numbers permits immediate correlation therebetween with little probability of error.

More particularly, device 10 includes a card 12 having an aperture 14 disposed therein. The dimensions of the aperture conform with the length and height of a plurality of numbers or set of numbers, generally identified by numeral 16, depicted upon a lottery ticket 18. A panel 20 is formed upon card 12 adjacent aperture 14 for having imprinted, written, applied or otherwise entered thereon a set of numbers, referenced by numeral 22. The panel may conform in length with aperture 14 to permit placement of numerals 22 in general alignment with numerals 16. It is to be understood that panel 20 may be simply an area upon card 12 rather than an element attached to card 12.

Figure 2:
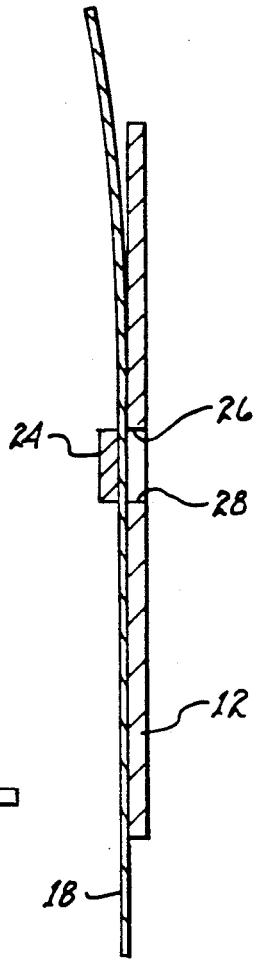
FIG. 2 is a side view taken along lines 2—2, as shown in FIG. 1.
Figure 3:
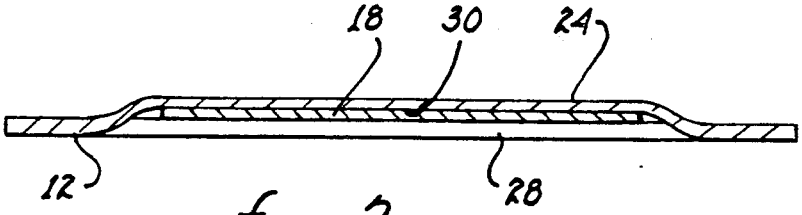
FIG. 3 is a top view taken along lines 3—3, as shown in FIG. 1.
Figure 4:
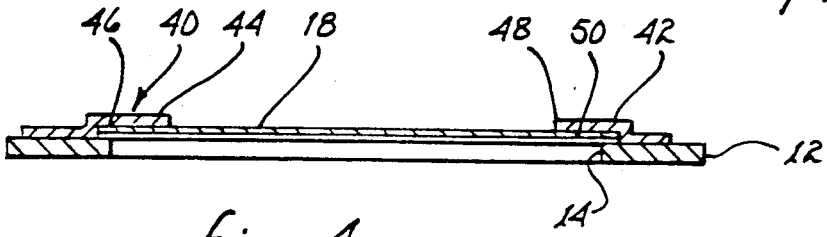
FIG. 4 illustrates an alternative embodiment for retaining a sliding element.

As particularly shown in FIGS. 2 and 3, the lottery ticket is retained adjacent the back of card 12 by a strap 24 to permit viewing of the face of the lottery ticket through window 14. The strap may be coincident with window 24, as depicted. With such construction, the strap is readily formed by cutting card 12 along lines 26,28 for a length commensurate with the width of window 14 to be formed. The strap may thereafter be pushed rearwardly out of the plane generally defined by card 12. A resulting planar displacement between card 12 and strap 24 provides a slot 30 through which card 18 may be passed.

By sliding card 18 through slot 30, set of numbers 16 can be brought into correspondence with window 14. Upon such correspondence, these numbers can be visually compared and correlated with the numbers appearing on panel 20.

In the event lottery ticket 18 includes a plurality of sets of numbers 16, the card can be incrementally slid through slot 30 to permit viewing one set of numbers at a time. Because of the limited viewing area provided by window 14, miscorrelation between different sets of numbers with the predetermined set of numbers 22 displayed on panel 20 will not occur.

Depending upon the structural strength and stiffness of lottery ticket 18, a strap 24 may be insufficient to maintain the lottery ticket juxtaposed with window 14 during the correlation process. To maintain the lottery ticket more firmly juxtaposed with the window, a pair of lateral guides 40,42 may extend from card 12. Lateral guide 40 includes a flange member 44 displaced from card 12 a distance sufficient to place edge 46 of lottery ticket 18 between the flange and card 12. Guide 42 includes an equivalent flange 48 defining a space 50 between the guide and card 12 for receiving edge 50 of lottery ticket 18. Guides 40 and 42 may be disposed on generally opposed sides of window 14 or they may extend vertically a substantial distance above and/or below the window.

Figure 5:
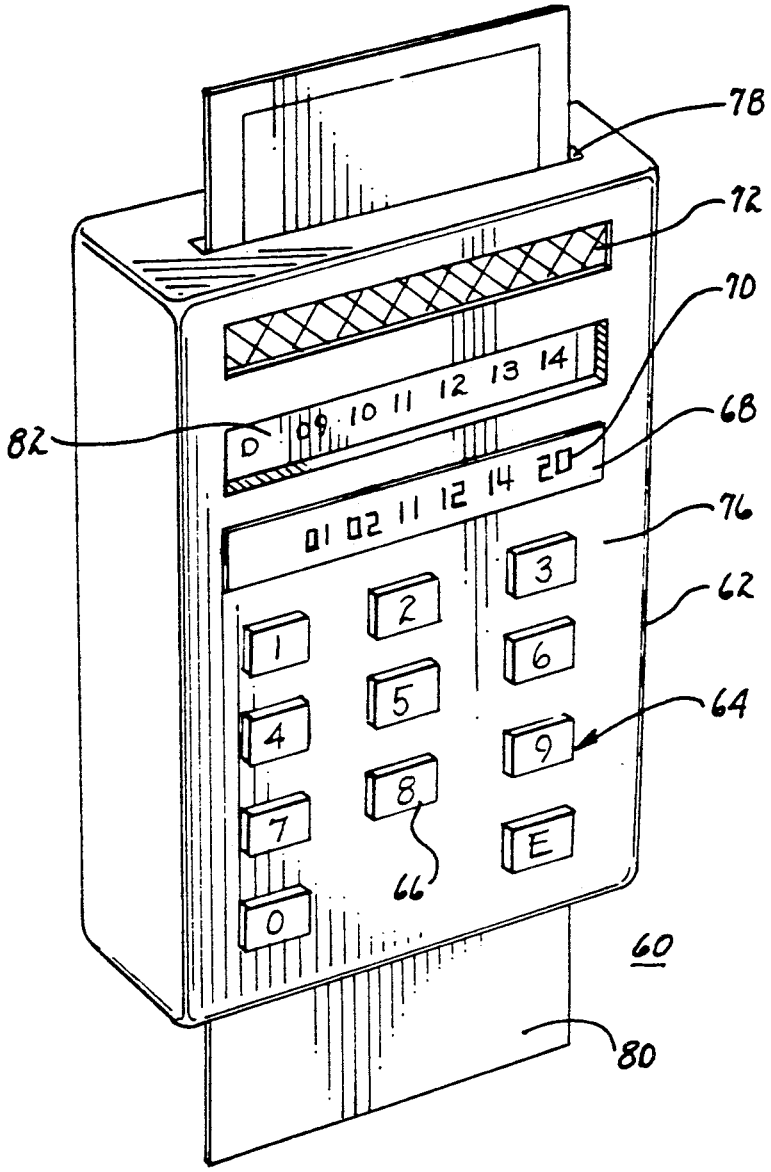
FIG. 5 illustrates an electronic variant.
Figure 6:
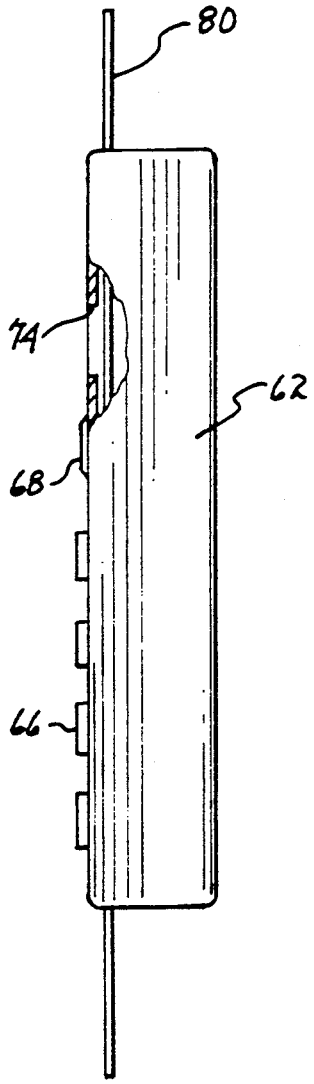
FIG. 6 illustrates a side view of the electronic variant.

Referring jointly to FIGS. 5 and 6, there is illustrated a variant 60 of device 10. This variant includes a housing 62 having a conventional keypad 64 mounted therein to provide access to the conventional keys, such as key 8 identified with numeral 66. Keypads of this type are readily available through electronic stores and supply houses. A display 68 includes a plurality of selectively actuatable indicia, such as light emitting diodes (LEDs). LEDs of this type are readily available and can be programmed through conventional off the shelf circuitry to display numerals pursuant to actuation of the keys of keypad 64. Accordingly, keypad 64 may be actuated to provide in display 68 a plurality of preselected numbers.

A source of electrical power for actuating keypad 64 and LEDs 70 may be by conventional batteries. With the substantial advances in solar panel technology, a solar cell panel 72 may be mounted in housing 60 to provide the requisite power to operate keyboard 64, display 68 and the related circuitry. Solar cell panels of a type suitable for use with variant 60 are readily available from electronic stores or other supply houses.

A window 74 is formed in face 76 of housing 62. A passageway or slot 78 extends from top to bottom of housing 62. This slot is sized in width and breadth to accommodate passage therethrough of a lottery ticket 80. The lottery ticket includes at least one set of numbers, identified by reference numeral 82, which may have been randomly assigned or selected by the lottery ticket purchaser. Window 74 is sized in length and height to correspond with the width and height of set of numbers 82. Thereby, primarily only set of numbers 82 will be visible at a time through window 74. In the event lottery ticket 80 includes a plurality of sets of numbers 82, the lottery ticket must be translated incrementally upwardly or downwardly in order to display, in a segregated manner, each set of numbers.

To determine whether set of numbers 82 appearing on lottery ticket 80 includes a combination of winning numbers, the numbers drawn in the lottery are entered by operation of keypad 64. These numbers will be displayed as numbers 70 in display 68. The arrangement of display 68 locates numbers 70 in general vertical alignment with numbers 82 of lottery ticket 80. Thereby, visual correlation between the two sets of numbers can be readily made to determine whether the lottery ticket includes a set of winning numbers.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. Apparatus for correlating a set of indicia on a medium with a predetermined set of indicia, said apparatus consisting of:

a) a planar card device for translatably supporting the medium;

b) a window disposed in said device, said window having a length and height corresponding with a set of indicia appearing on the medium;

c) means for retaining the medium juxtaposed with the perimeter of said window to permit viewing the set of indicia on the medium through said window, said retaining means comprising a strap coincident with said window and formed by a pair of parallel slits disposed in said planar card; and d) a panel for displaying adjacent said window the predetermined set of indicia, said panel including means responsive to a writing implement for erasably receiving and displaying the predetermined set of indicia; whereby, the set of indicia on the medium can be correlated with the predetermined set of indicia.

2. Apparatus for correlating a set of indicia on a medium with a predetermined set of indicia, said apparatus comprising in combination:

a) a device for translatably supporting the medium;

b) a window disposed in said device, said window having a length and height corresponding with a set of indicia appearing on the medium;

c) a strap for retaining the medium juxtaposed with the perimeter of said window to permit viewing the set of indicia through said window, said strap being a part of said device and defined by a pair of parallel slits formed in said device; and d) means for displaying adjacent said window the predetermined set of indicia; whereby, the set of indicia on said medium can be correlated with the predetermined set of indicia.

3. The apparatus as set forth in claim 2 wherein said panel includes means responsive to a writing implement for receiving and displaying the predetermined set of indicia.

4. Apparatus for correlating a set of indicia on a medium with a predetermined set of indicia, said apparatus consisting of:

a) a device for translatably supporting the medium, said device including a manually actuated keypad for generating signals representative of the predetermined set of indicia;

b) a window disposed in said device, said window having a length and height corresponding with a set of indicia appearing on the medium;

c) means for translating the medium through said device and for retaining the medium juxtaposed with the perimeter of said window to permit viewing the set of indicia on the medium through said window, said translating means including a straight passageway extending through said device for receiving the medium; and d) a panel for displaying adjacent said window the predetermined set of indicia in response to actuation of said keypad;

whereby, the set of indicia on the medium can be correlated with the predetermined set of indicia.

5. The apparatus as set forth in claim 4 including a solar cell panel for providing power to said displaying panel and said keypad.

* * * * *